US006863228B2

(12) United States Patent
Mao et al.

(10) Patent No.: US 6,863,228 B2
(45) Date of Patent: Mar. 8, 2005

(54) DISCRETE JET ATOMIZER

(75) Inventors: Chien-Pei Mao, Clive, IA (US); John Earl Short, Norwalk, IA (US)

(73) Assignee: Delavan Inc., Wilmington, DE (US)

( * ) Notice: Subject to any disclaimer, the term of this patent is extended or adjusted under 35 U.S.C. 154(b) by 60 days.

(21) Appl. No.: 10/261,138

(22) Filed: Sep. 30, 2002

(65) Prior Publication Data

US 2004/0061001 A1 Apr. 1, 2004

(51) Int. Cl.[7] ..... B05B 7/10
(52) U.S. Cl. ..... 239/399; 239/405; 60/748
(58) Field of Search ..... 239/398, 399, 239/403, 405, 406, 418, 461, 419.5; 60/740, 748

(56) References Cited

U.S. PATENT DOCUMENTS

| | | | | |
|---|---|---|---|---|
| 4,070,826 | A | | 1/1978 | Stenger et al. |
| 4,767,057 | A | | 8/1988 | Degli et al. |
| 5,144,804 | A | * | 9/1992 | Koblish et al. ..... 60/740 |
| 5,256,352 | A | | 10/1993 | Snyder et al. |
| 5,579,645 | A | | 12/1996 | Prociw et al. |
| 6,082,113 | A | | 7/2000 | Prociw et al. |
| 6,272,840 | B1 | | 8/2001 | Crocker et al. |
| 6,289,676 | B1 | | 9/2001 | Prociw et al. |
| 6,289,677 | B1 | | 9/2001 | Prociw et al. |

OTHER PUBLICATIONS

Engineering Department Performance Study of a Fuel–Air Mix Nozzle Design Concept (Delvan Part No. 30457), Delvan, Inc. (Oct. 12, 1970).

Norgren, Carl T. et al., "Effect of Fuel Injector Type on Performance and Emissions of Reverse–Combustor," NASA Technical Paper 1945 (1981).

Norgren, Carl T. et al., "Small Gas–Turbine Combustor Study—Fuel Injector Evaluation," NASA Technical Memorandum 82641 (Jul. 27–29, 1981).

Iannetti, A. et al., "Towards Accurate Prediction of Turbulent, Three–Dimensional, Recirculating Flows with the NCC," NASA/TM–2001–210761 (Mar. 2001).

* cited by examiner

*Primary Examiner*—Michael Mar
*Assistant Examiner*—Thach H. Bui
(74) *Attorney, Agent, or Firm*—Thompson Hine LLP

(57) ABSTRACT

An atomizer including a fuel output portion shaped to provide a fuel output and an air swirler portion shaped to direct streams of air at the fuel. The air swirler portion includes an outer opening and an inner opening located radially inwardly relative to the outer opening. The inner and outer openings are arranged such that an air stream passed through the inner opening does not intersect a conical section defined by an air stream passed through the outer opening unless both of said air streams are moving at least partially radially outwardly.

31 Claims, 7 Drawing Sheets

DISCRETE JET ATOMIZER

The present invention is directed to an atomizer, and more particularly, to an atomizer for creating a liquid/gas spray.

BACKGROUND

Liquid atomizers are widely used in industrial, agricultural, propulsion and other systems. Such liquid atomizers are typically used to produce a spray (i.e., a liquid/gas mixture including fine droplets of the liquid) for various purposes, such as creating a spectrum of droplets, control or metering of liquid throughput, dispersion of liquid droplets for mixing with surrounding air, and generation of droplet velocity or penetration. In one embodiment, the transformation of bulk liquids to sprays can be achieved, for example, by directing various forms of energy, such as hydraulic, pneumatic, electrical, acoustical, or mechanical energy, to the bulk liquid to cause the liquid to break up into droplets.

Pneumatic atomizers are often used in gas turbine engine applications. Most pneumatic atomizers used in gas turbine engine applications include an atomizer tip which includes two components: a fuel swirler and an air swirler. The fuel swirler may receive a liquid in one end and eject or feed the liquid through an exit orifice, typically in a spiral motion, to generate a film or spray of liquid. The air swirler (such as a discrete jet air swirler) may direct pressurized air towards the outputted liquid such that the pressurized air impinges upon the liquid, breaks the liquid into a spectrum of droplets, and disperses the droplets.

In such pneumatic atomizers, the air streams are typically either high volume, low-pressure drop air streams, or low volume, high-pressure drop air streams that are directed toward the bulk liquid to impinge upon, or shear against, the liquid film or spray. The air streams directed toward or over the bulk liquid often includes a rotational component or a "swirl" motion to enhance mixing and interaction with the liquid surface, as well as to improve dispersion of the liquid droplets. Thus, the air streams may be arranged and controlled to produce the desired distribution and uniformity of fuel droplets, as well as the desired angle of the fluid droplets spray. In particular, in gas turbine applications, the atomizer preferably provides a fuel spray that allows the gas turbine to operate over a wide range of combustion limits over extended periods of time with low acoustic noise and low emission pollutants.

Air swirlers are often still designed by trial-and-error techniques, which involves much development effort and time to fine tune the design geometry or to achieve the desired spray characteristics. Furthermore, the air streams emerging from the air swirler may overlap and cross each other in the vicinity of the air swirler, which results in energy loss, decreased spray control and narrow spray angles. When used in a gas turbine engine, such atomizers with crossing air streams may result in a relatively narrow range of combustion stability limits, excessive acoustic noise, and high levels of smoke at low power conditions. Such atomizers may also experience carbon formation on the atomizer face and difficulty in high altitude re-light. In some prior art designs, the air streams are designed to cross to collapse the spray in an attempt to reduce smoke and alleviate the presence of hot spots on the liner walls.

Accordingly, there is a need for air swirlers and atomizers which are more efficient and effective, as well as a methodology for designing air swirlers and atomizers.

SUMMARY

The present invention may be an atomizer or air swirler which can provide favorable air streams, fuel sprays and fuel/air mixtures. In use, such as in gas turbine engine applications, the air swirlers and atomizers may be energy efficient, and provide noise reduction, carbon alleviation, and improved ignition and combustion stability. The present invention may also include a methodology for designing air swirlers and atomizers.

In one embodiment the invention is an atomizer including a fuel output portion shaped to provide an output of fuel and an air swirler portion shaped to direct streams of air at the output fuel. The air swirler portion includes at least one outer opening and at least one inner opening located radially inwardly relative to the outer opening. The inner and outer openings are arranged such that an air stream passed through the inner opening does not intersect a conical section defined by an air stream passed through the outer opening unless both of said air streams are moving at least partially radially outwardly.

Other objects and advantages of the present invention will be apparent from the accompanying drawings and descriptions.

DETAILED DESCRIPTION

Figure 1:
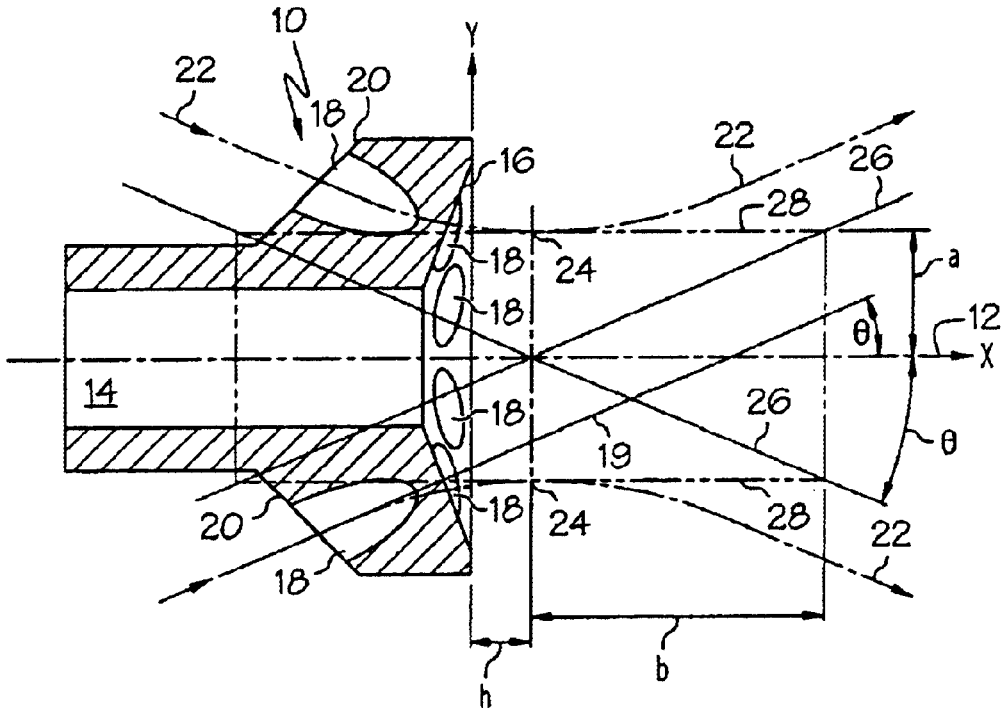
FIG. 1 is a side cross section of an air swirler illustrating the various geometries and coordinates of an air swirler with a single set of holes.

FIG. 1 illustrates an air swirler 10 and a coordinate system and design parameters for determining the patterns of the air streams passing therethrough. The air swirler 10 of FIG. 1 includes a central axis 12 (the x axis of FIG. 1) and an axially-extending opening 14 centered about the central axis 12. The air swirler 10 includes a front face 16 and a set of radially spaced openings 18 extending from a back surface 20 of the air swirler 10 to the front face 16 thereof. Each of the openings 18 may have a generally circular cross section and a central axis 19. However, the openings 18 may have different shapes besides circular, such as an "airfoil" or quadrilateral shape.

Each of the openings 18 is spaced apart from the central axis 12 of the air swirler 10 at the front face 16 by a radial offset distance a. The central axis 19 of each of the openings 18 may form an angle with the central axis 12 of the air swirler 10 by an angle designated the angular offset θ, which may be an acute angle. Each of the openings 18 may be preferably aligned such that each of the openings 18 has an essentially identical value for a and θ. Each of the openings 18 may have an angle of inclination (not shown) such that air passed through each of the openings 18 has a velocity component that extends into and out of the page of FIG. 1 (see FIG. 2*a*).

Figure 4:
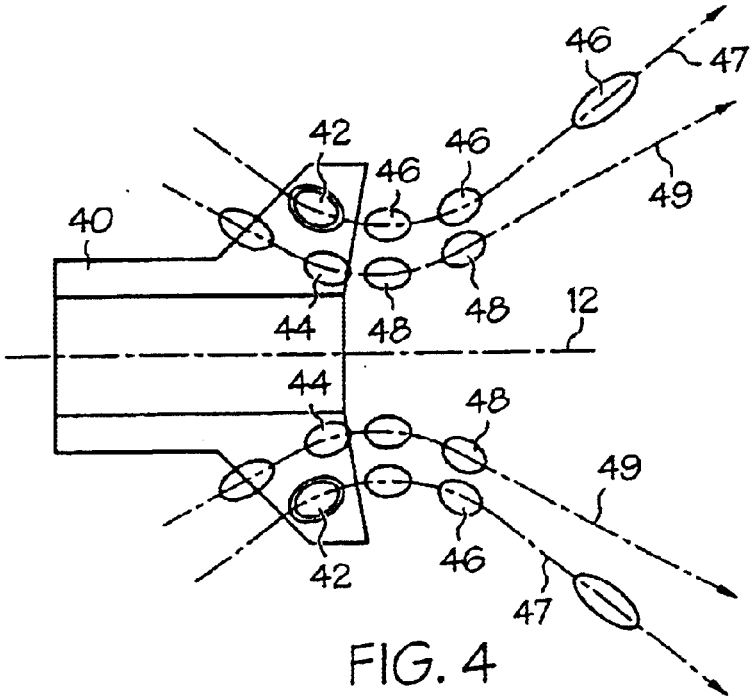
FIG. 4 is a side cross section of the schematic representation of FIG. 2*b*, taken along lines 4—4.
Figure 5:
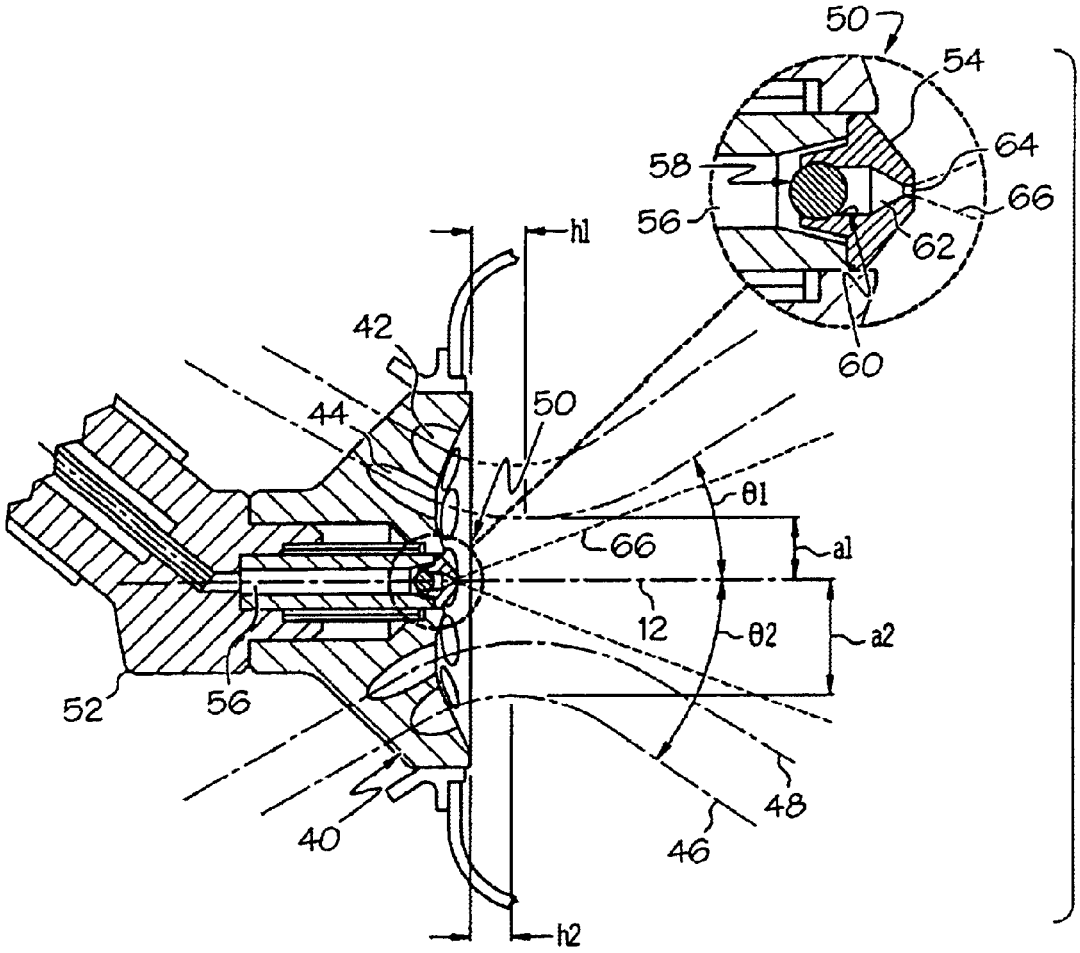
FIG. 5 is a side cross section of an atomizer system including a fuel swirler and the air swirler of FIG. 2.
Figure 6:
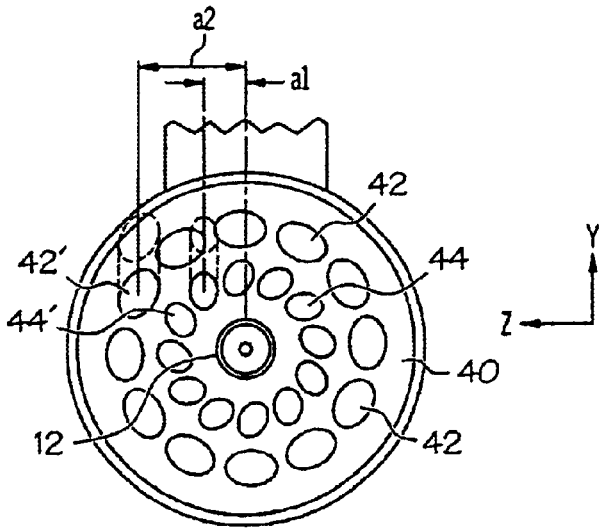
FIG. 6 is a front view of the atomizer of FIG. 5.
Figure 7:
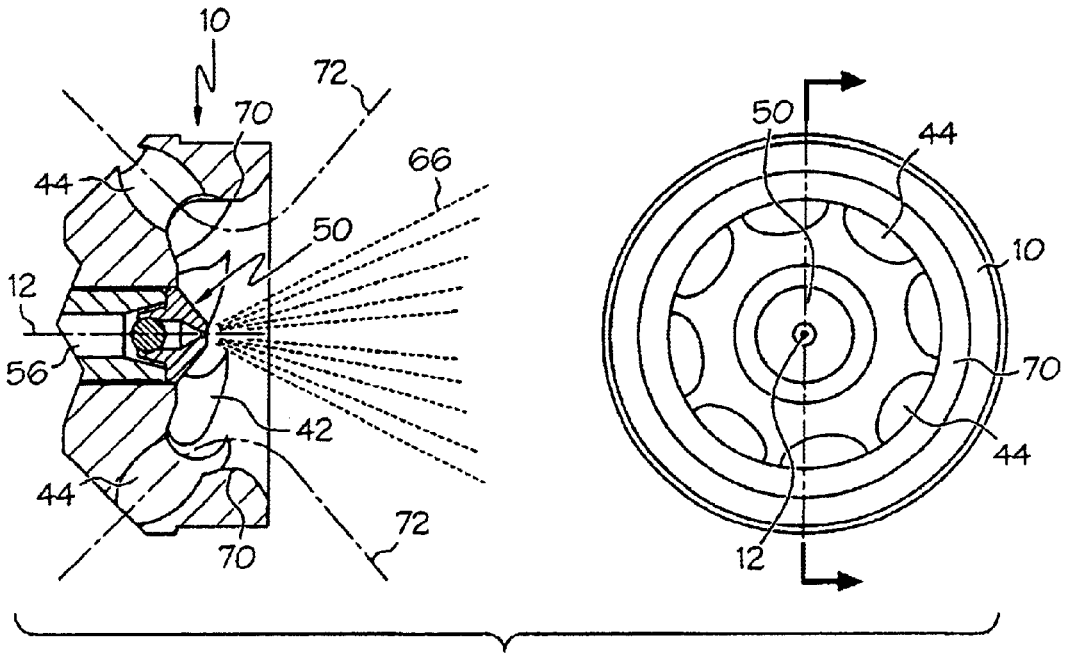
FIG. 7 is a side cross section and front view of an atomizer including an alternate air swirler.

When compressed air is passed through the openings 18, illustrated as projected air streams 22, the air streams 22 follow a generally hyperbolic path. FIGS. 1–2 and 3–9 illustrate the path of air streams (such as air streams 22 of FIG. 1) that are passed through the openings. However, because each of the air streams may include velocity components in three dimensions, the air streams illustrated in each of FIGS. 1–2 and 3–9 represent projections of the air stream. For example, as shown in FIG. 1, each of the air streams 22 are projected onto the x-y plane, and FIG. 6 illustrates the air streams 46 and 48 projected onto the y-z plane.

As shown in FIG. 1, the projection of each of the air streams 22 on the x-y plane may have a predominantly axial velocity component, but also have a radial velocity component which is initially a radially inward velocity component when the air streams first exit the air swirler 10, and eventually transitions to a radially outward velocity component at a location termed the pinch point 24. Thus, the air streams 22 first converge inwardly towards the pinch point 24 that is typically located a short distance within the nozzle face 16 (i.e., about ±3a or about ±10a.). The air streams 22 then begin to diverge radially outwardly from the pinch point 24 to disperse the droplets into a circular cross sectional area. The axial distance from the front face 16 of the air swirler 10 to the pinch point 24 is designated by the dimension h.

It should be understood that the pinch point 24 may be located inside the air swirler 10 (that is, the pinch point may be located to the left of the outer edge of the front face 16 of FIG. 1). In this case, the dimension h may be designated to have a negative value. However, the distance from the front face 16 is generally measured as a positive number; that is, h may represent the absolute value of the distance from the front face 16.

The projection of the hyperbolic path of the air streams 22 includes a pair of asymptotes 26, each of which extends generally parallel to the central axis 19 of the openings 18 and intersect at the distance h. A pair of lines 28 extend generally axially and are tangential to the hyperbolic air streams 22 at the pinch point 24. The downstream offset b is the axial distance from the point of intersection of the asymptotes 26 (or from the pinch point 24) to the point where the asymptotes 26 intersect the line 28.

The path of the projection of the airstreams 22 shown in FIG. 1 can be defined by the following hyperbolic equation:

$$\frac{y^2}{a^2} - \frac{(x-h)^2}{b^2} = 1$$

With reference to FIG. 1, it can be based upon simple trigonometry that tan $$\theta = \frac{a}{b}.$$

Accordingly, with this equation in mind, the paths or the projections of the paths of the air streams 22 can be plotted and determined in advance by knowing the radial offset distance a, pinch point distance h and angular offset θ. The radial offset a may be desired to be set at a maximum distance allowed by the geometry of the swirler 10.

Figure 2:
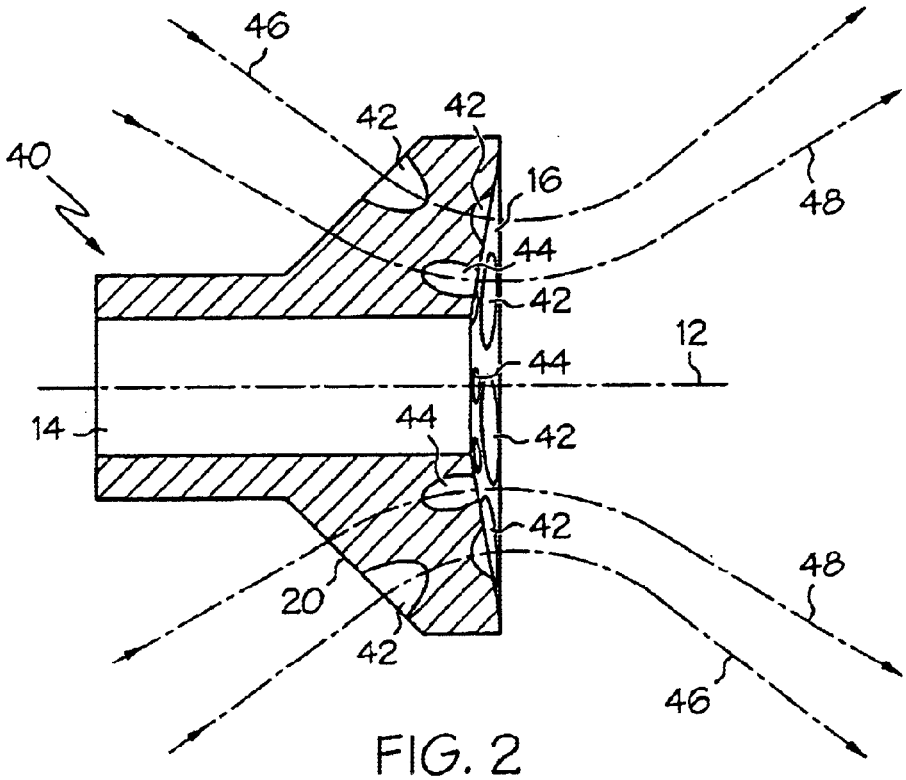
FIG. 2 is a side cross section of an air swirler with two sets of holes illustrating air streams that do not cross.

As shown in FIGS. 2 and 6, an air swirler 40 may include at least two sets of holes or openings 42, 44. As shown in FIG. 6, the air swirler 40 may include a set of outer openings 42 arranged in a generally circular configuration and a set of inner openings 44 arranged in a generally circular configuration. The set of inner openings 44 may be generally concentric with the set of outer openings 42, with each set of openings 42, 44 being arranged around the central axis 12. The set of inner openings 44 may be generally smaller than the set of outer openings 42. As shown in FIG. 5, the inner openings 44 and projection of the inner flow paths 48 may have the parameters $a_1$, $\theta_1$ and $h_1$, and the outer openings 42 and projection of the outer flow paths 46 may have the parameters $a_2$, $\theta_2$ and $h_2$.

Figure 2A:
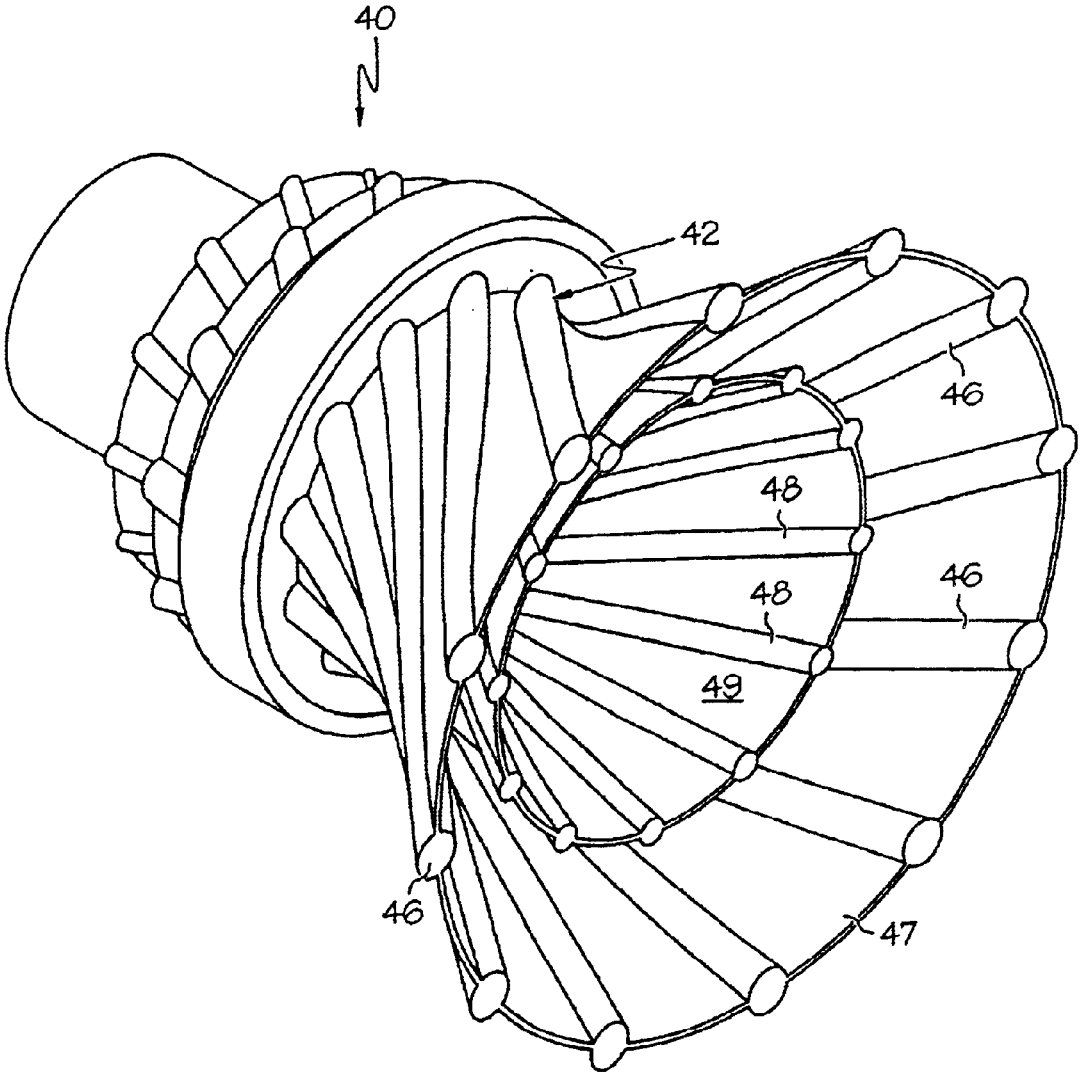
FIG. 2*a* is a schematic three-dimensional representation of the air flow passed through the air swirler of FIG. 2.
Figure 2B:
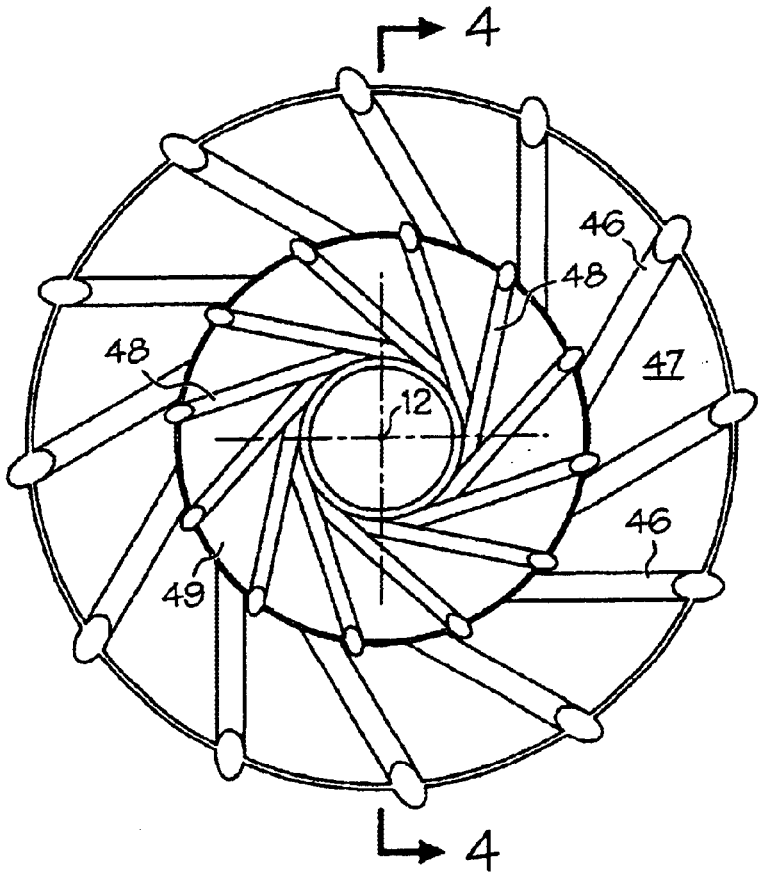
FIG. 2*b* is a front view of the schematic representation of FIG. 2*a;*

FIG. 2*a* illustrates a three dimensional plot of the air swirler 40 of FIG. 2, and the air streams 46,48 passed therethrough. As can be seen, the air streams 46 are located in the profile of a three dimensional hyperbola 47, and the air streams 48 are located in the profile of a three dimensional hyperbola 49. In other words, hyperbola 47 (or 49) may be visualized as a body of rotation defined by the projection of an air stream 46 (or 48) as rotated about the central axis 12. As shown in FIGS. 2*b* and 4, the individual streams of air 46,48 cut through a vertical plane passing through the central axis 12 (i.e., the plane defined by line 4—4 of FIG. 2*b*). As shown in FIGS. 2*b* and 2*c*, the individual streams of air 46, 48 cut through a vertical plane passing through the central axis 12 (i.e., the plane defined by line 2*c*—2*c*).

As noted above, FIG. 2 includes a projection of the flow paths 46, 48 on the x-y plane. Thus, only openings 42', 44' (see FIG. 6), which are spaced apart from the central axis 12 by a distance of $a_2$ and $a_1$ respectively, will truly have a angle of $\theta_1$ and $\theta_2$ projected upon the x-y plane. The remaining openings 42, 44 will have lesser values of the angles $\theta_1$ and $\theta_2$ projected upon the x-y plane. Thus, the angular offset θ may be defined as the maximum angle any one opening of a set of openings forms with a plane that passes through the central axis 12.

As shown in FIG. 5, the air swirler 40 of FIG. 2 may be used with a fuel swirler 50, such as a simplex injection tip, to create a discrete jet atomizer 52. The simplex injection tip 50 is a well-known component which includes a fuel swirler cone 54 connected to a fuel delivery line 56, and a sealing ball 58 may be disposed in the fuel swirler cone 54. The simplex injection tip 50 and fuel delivery line 56 are received inside the opening 14 of the air swirler 40. In operation, liquid fuel in the fuel delivery line 56 is forced under pressure through a set of offset spin holes 60 on the fuel cone 54 and into a hollow swirl chamber 62 inside the fuel cone 54. The spiral motion of the liquid fuel in the swirl chamber 62 induces the formation of an air core inside the swirl chamber 62 toward the exit orifice 64 of the swirl chamber 62. Thus, as liquid fuel emerges from the orifice 64, liquid fuel spreads radially outwardly to form a conical film 66 in a well-known manner. The air streams passing through the air swirler 40 impinge upon the fuel spray cone 66 to atomize the fuel spray 66 into droplets and disperse the droplets in the desired manner.

The air swirler 10 and atomizer 52 preferably are located and arranged such that there are no physical structures or components located in the vicinity of the air swirler such that the air streams 46, 48 are free to follow their natural hyperbolic path. For example, in one embodiment, there are no physical structures or components located with a distance of at least about the radial offset distance a or about three times or ten times the radial offset a in the downstream direction.

Although the velocity of air flowing through the inner 44 and outer 42 set of openings may be about the same, the lower volume air streams 48 passing through the inner set of holes 44 can provide initial atomization of the fuel and the stronger impact air streams 46 passing through the outer set of openings 42 may disperse and deliver the droplets to the desired areas. Thus, the atomized fuel droplets tend to follow the air streams 46, 48 along their flow paths, which deliver the atomized fuel to the desired areas for mixing and combustion and the outer air streams 46 help to increase atomization and provide a more desired spray angle. Thus, in the embodiment shown in FIG. 2, the outer 46 and inner 48 air streams assist each other to provide an efficient atomization and droplet dispersion.

When air streams 46,48 are passed through each of the openings 42,44 (i.e., by passing compressed air through each of the openings 42, 44), it may be desired that the projections of the air streams 46, 48 remain generally parallel or, at a minimum, do not intersect while in the vicinity of the front face 16. When the projections of the air streams 46, 48 cross or intersect, the projection of the air streams 48 of the inner set of holes 44 may intersect the projection of the air stream 46 of the outer sets of holes 42 upstream of the pinch point of the air stream 46. The inner air streams 48 may have a wider angle than the outer air streams 46 and thus the air stream 46 may end up located inside the air stream 48.

When the air streams 46, 48 (or their projections) cross over each other the energy and directed velocity of the intersecting streams 46, 48 is lost due to interference between the air streams 46, 48. Thus, in the crossing configuration the flow path of the projected inner air streams 48 tends to cut through the projected outer air streams 46 which results in a random and disturbed spray pattern. Furthermore, the crossing air streams 46, 48 may not be properly directed at the fuel spray 66 which reduces the air streams' effect upon the fuel spray 66, thereby reducing atomization of the bulk liquid. When used in gas turbine engine applications, air swirlers which have crossing air streams can lead to problems of altitude re-light, may provide a relatively narrow range of combustion stability limits, high levels of smoke at low power conditions, and increased acoustic noise.

Figure 3:
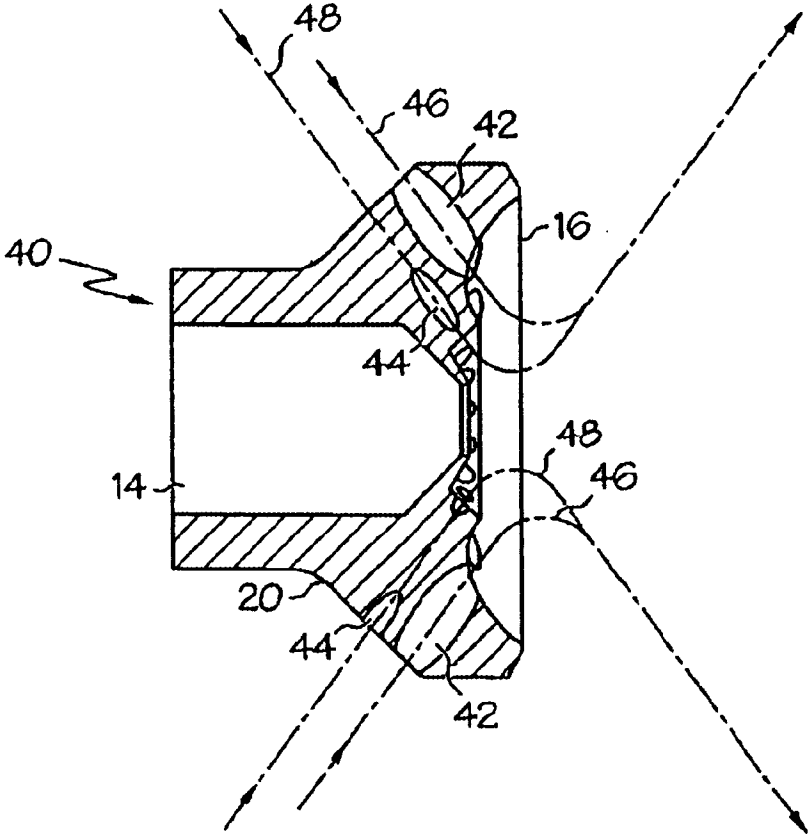
FIG. 3 is a side cross section of an air swirler with two sets of holes illustrating air streams which merge downstream.

Accordingly, it may be desired to provide an air swirler in which the air streams 46, 48 (or their projections) do not cross each other. For example, the projections of the air streams 46, 48 in the embodiment of FIG. 2 remain somewhat parallel (or diverge slightly in the downstream direction) and do not cross. However, in some cases the flow configuration of FIG. 2 (i.e., fully non-overlapping, non-intersecting air streams) cannot be achieved due to physical limitations in the air swirler 40 or other atomizer components. Thus, as shown in FIG. 3, the air streams 46, 48 (or their projections) may also be allowed to merge sufficiently downstream to minimize disruption of the stable flow regime. In this embodiment the projections of the air streams 46, 48 merge together into a single air stream at a sufficient distance in the downstream direction, but not cross or intersect.

In this manner, an inner air stream 48 preferably does not intersect an outer air stream 46 (or the hyperbola or conical section 47 defined by one or more of the air streams 46), but if they do intersect they do not intersect until or unless both of the intersecting air streams 46, 48 are moving at least partially radially outwardly relative to the central axis 12. The inner 44 and outer 42 openings may be arranged such that an inner air stream 48 (or its projection) does not intersect an outer air stream 46 (or its projection) within a distance of, for example, at least about three times the radial offset distance of the outer openings 42, or at least about ten times the radial offset distance of the outer openings 42. In other words, the air streams 46, 48 (or their projections) do not intersect, or if they do intersect, the air streams 46, 48 (or their projections) may both be moving at least partially outwardly relative to the central axis 12 when the streams 46, 48 (or their projections) do intersect.

The atomizer may include more than two sets of openings 42, 44. In this case, each of the sets of openings may be arranged so that the projections of the streams of air passed through each of the openings do not intersect in the same or similar manner discussed above.

In order to arrange the openings 42, 44 of the air swirler 10 such that the air streams 46, 48 do not cross, plots of the air streams 46, 48 based upon a given radial offset distance a, pinch point distance h and angular offset θ can be calculated. The resultant hyperbolic curves for the air streams 46, 48 passing through the openings 42, 44 can then be plotted, and the designer can review the graphical plots or data to determine whether the air streams 46, 48 (or the 2-D projections of the air streams 46, 48) cross. If the air streams 46, 48 do cross (as in FIG. 4), then the various dimensions (a, h and θ) can be modified until the desired result is achieved.

When the air swirler 40 of FIGS. 2 and 3 (i.e., having non-intersecting projected air streams 46, 48) is used as part of an atomizer in gas turbine engine application, the resultant atomizer may provide increased combustion stability limits, reduced acoustic noise, uniform spray and well-atomized droplet sizes, all of which produce a well mixed fuel/air mixture favorable for high combustion efficiency and low emissions.

In this manner, an air swirler can be designed and constructed using methodology that allows the preview of the air stream patterns so that the designer can ensure the air swirler provides an efficient aerodynamic pattern to control liquid atomization, droplet dispersion, spray pattern and flow structure. After the desired pattern of air streams is established, the dimensions a, h and θ can be provided to a manufacturer so that the air swirler body can be constructed in the desired manner.

The air atomizer 40 can be used in combination with any of a wide variety of fuel swirlers or injectors to create any of a wide variety of atomizers. For example, the air swirler 40 of the present invention can be used with a wide variety of fuel swirlers beyond simplex injection tips, including but not limited to simplex, duplex, dual orifice and annular prefilming atomizer tips, or combinations thereof (such as piloted tips). Furthermore, the discrete jet atomizer 52, which is shown in FIG. 5, can be modified to accommodate extended flow rate requirements equipped with dual fuel circuits. This type of discrete jet atomizer could be constructed by replacing the simplex injection tip 50 with either a duplex or a dual orifice injection tip that allows an extended flow rate control with higher fuel turndown ratio. Furthermore, although the air swirler is illustrated as including a series of discrete openings and air streams, the air swirler needs only to include a single or a pair of openings, such as a pair of generally annular openings which may or may not include vanes.

As noted above, it may be desired to arrange the air swirler such that air streams passed therethrough do not intersect. However, it may also be desired to arrange the air swirler and fuel swirler such that the air streams passed through the air swirler do not intersect or cross through the fuel spray cone 66. In general, it is desired that the air streams be arranged to approach and then extend away from the fuel spray cone, although in some cases the innermost air streams may be desired to intersect the fuel spray cone to collapse the spray to control the spray angle.

In some prior art air swirlers, the internal wall or components of the air swirler interferes with the air streams. Thus, in the embodiment of FIG. 7, the air swirler 10 includes a curved interior wall 70 which conforms to the trajectory of the projected air streams 72. More particularly, the interior wall 70 is preferably convex with respect to the central axis 12 of the air swirler 10 to ensure the air streams 72 pass smoothly over the wall 70. This curvilinear design of the inner surface 70 enables the atomizing air streams 72 to fully engage with the liquid fuel film 66 inside the air swirler 10 to form a premixed fuel/air mixture. Although the air swirler of FIG. 7 includes only a single set of openings 44, multiple arrays or set of openings can be included in the air swirler 10 of FIG. 7.

Figure 8:
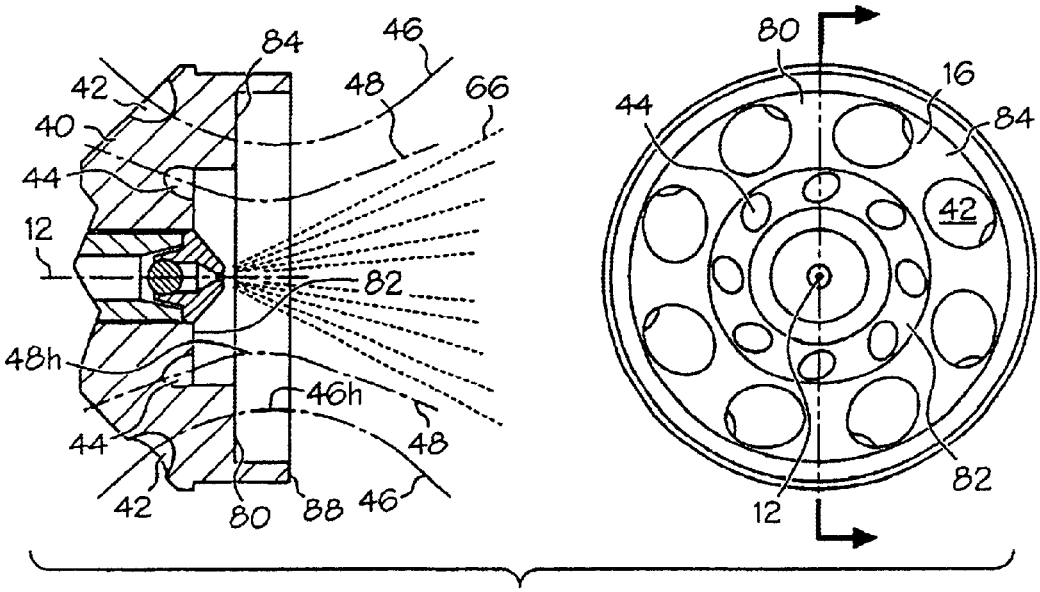
FIG. 8 is a side cross section and front view of an atomizer including another alternate air swirler.

FIG. 8 illustrates another discrete jet swirler which includes a stepped interior wall 80 and two sets of openings 42, 44. The inner set of openings 44 are located on the inner (rearward) tier 82 and the outer set of openings 42 are located on the outer (forward) tier 84. In this manner, the sets of openings 42, 44 and corresponding pinch point locations 46*h*, 48*h* can be axially and radially spaced to allow the desired spray pattern to be produced. For example, the stepped wall 80 of the air swirler 40 of FIG. 8 provides for flexibility in the location of the openings 42, 44 such that the openings 42, 44 can be located at the proper angle and radial position to produce the desired air pattern. Although FIG. 8 illustrates only two tiers 82, 84 and two sets of openings 42, 44, a greater number of tiers and/or sets of openings can be used.

The projection of the air streams 48 passed through the inner openings 44 may have a pinch point 48*h* located inside the air swirler 10 (i.e., spaced axially inwardly from the outermost portion 88 of the front face 16), and the projection of the air streams 46 passed through the outer openings 42 may have a pinch point 46*h* located outside the body of the air swirler 10. The trajectories of the projections of the two air streams 46, 48 may be generally parallel to each other along the center axis 12 to keep the spray angle constant at varying conditions.

Figure 9:
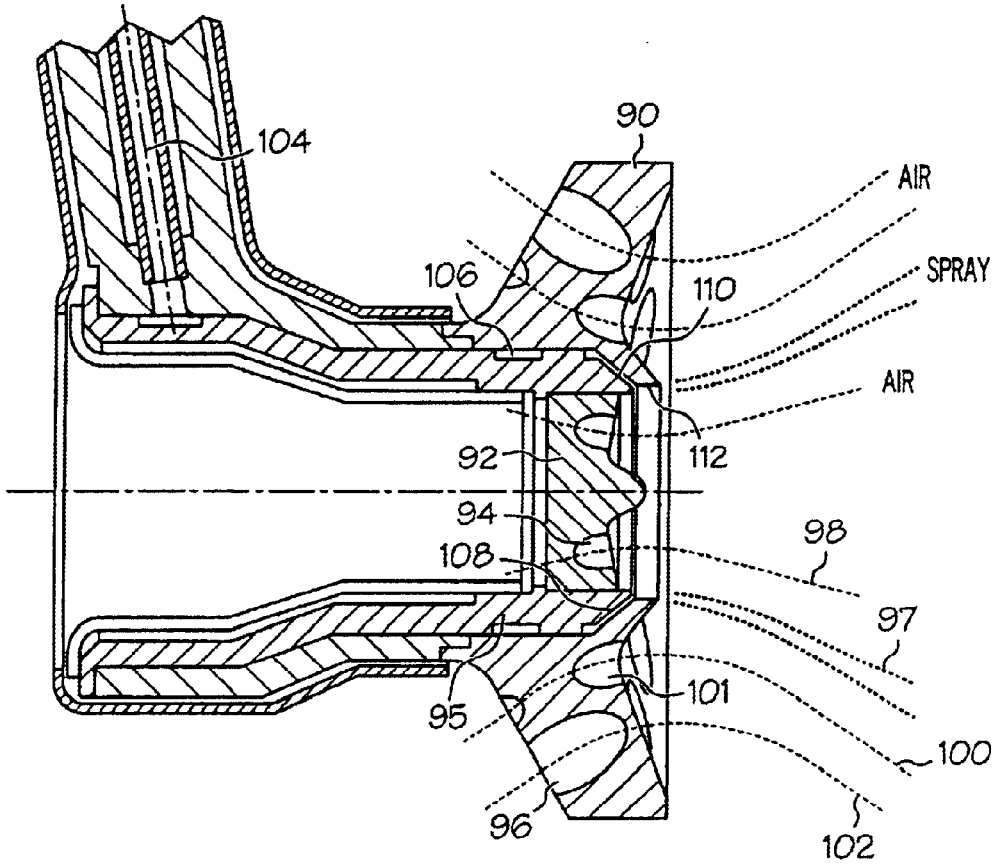
FIG. 9 is a side cross section of an atomizer including two air swirlers and a pre-filming type fuel swirler device.

FIG. 9 illustrates another embodiment of the present invention which includes two air swirler components 90, 92 used with a fuel swirler 95 in the form of an annular prefilming injection device. The inner air swirler component 92 includes one set of openings 94 which produces air streams 98, and the outer air swirler 90 includes two concentric sets of openings 96, 101. With the aid of the air swirler components 90, 92, the fuel swirler 95 ejects a fuel spray 97 that is located between the air streams 98 of the inner air swirler component 92 and the air streams 100, 102 of the outer air swirler component 90.

The fuel swirler 95 of FIG. 9 may be a well-known prefilming fuel ejection device. In particular, the fuel swirler 95 may be coupled to a fuel delivery line 104 which delivers fuel through a winding passage 106 to one of a plurality of spin slots 108 and into an annular fuel gallery 110. The fuel, which may have a spiral or swirl velocity is imparted to the fuel by the spin slots 108, then the fuel reaches a prefilmer area 112 which allows the liquid film to attach as a film and prepare for uniform release in the circumferential direction. The inner air streams 98 then impinge upon and attack the inner surface of the liquid film, and the outer air streams 100, 102 impinge upon and attack the outer surface of the liquid film to create the fuel spray 97, and disperse the fuel spray in the desired manner. In the embodiment of FIG. 9, in the same manner as discussed above, it may be desired that each of the air streams 98, 100, 102 not intersect, or that the air streams 98, 100, 102 merge together at a sufficient distance in the downstream direction.

Having described the invention in detail and by reference to the preferred embodiments, it will be apparent that modifications and variations thereof are possible without departing from the scope of the invention.

What is claimed is:

1. An atomizer comprising:

a fuel output portion shaped to provide an output of fuel; and an air swirler portion shaped to direct streams of air at said fuel, said air swirler portion including an outer opening and an inner opening located radially inwardly relative to said outer opening, said inner and outer openings being arranged such that an air stream passed through said inner opening does not intersect a body of rotation defined by an air stream passed through said outer opening unless both of said air streams are moving at least partially radially outwardly at said intersection.

2. The atomizer of claim 1 wherein said inner and outer openings are arranged such that the air streams passed therethrough are initially directed at least partially radially inwardly.

3. The atomizer of claim 1 wherein said atomizer has a central axis, and wherein a central axis of each opening forms an acute angle with a central axis of said air swirler portion.

4. The atomizer of claim 3 wherein said fuel output portion is shaped to create a spray of fuel which travels in a downstream axial direction.

5. The atomizer of claim 1 wherein said air swirler portion includes a plurality of outer openings arranged in a configuration and a set of inner openings arranged in a configuration that is generally concentric with said set of outer openings.

6. The atomizer of claim 5 wherein said atomizer has a central axis and each of said inner and outer openings are each arranged in a generally circular pattern about said central axis, and wherein each opening of said inner and outer set of openings is radially spaced apart from any adjacent openings.

7. The atomizer of claim 1 wherein said fuel output portion includes an orifice through which fuel can be passed to create said fuel spray when fuel is passed therethrough.

8. The atomizer of claim 7 wherein said fuel output portion is shaped to create a generally conical fuel spray when fuel is passed therethrough.

9. The atomizer of claim 1 wherein said fuel output portion includes a simplex, duplex, dual orifice or annular pre-filming atomizer tip.

10. The atomizer of claim 1 wherein said atomizer includes an outer wall portion located adjacent to said opening, said outer wall portion being generally curved and having a convex portion which generally conforms to the path of an air stream passed through said outer opening.

11. The atomizer of claim 1 wherein said air swirler portion includes a generally stepped inner surface having an inner tier and an outer tier, and wherein said inner opening is located on said inner tier and said outer opening is located on said outer tier.

12. The atomizer of claim 1 wherein said outer opening is larger than said inner opening.

13. The atomizer of claim 1 wherein said air streams passed through said openings follow a generally hyperbolic path for a distance of at least the radial offset of said outer set of openings.

14. An atomizer comprising:

a fuel output portion shaped to provide an output of fuel; and an air swirler portion shaped to direct streams of air at said fuel, said air swirler portion including an outer opening and an inner opening radially spaced apart from a radial center of said atomizer by a radial offset distance, said inner and outer openings being arranged such that an air stream passed through one of said inner opening does not intersect a body of rotation defined by an air stream passed through one of said outer openings within an axial distance of at least about three times the radial offset distance measured from a front face of said atomizer.

15. An air swirler comprising:

a swirler body;

at least one set of outer openings located in said swirler body and arranged in a configuration; and at least one set of inner openings located in said swirler body and arranged in a configuration that is generally concentric with said set of outer openings, said inner and outer openings being arranged such that an air stream passed through one of said inner openings does not intersect an air stream passed through one of said outer openings when at least one of said air streams is moving at least partially inwardly.

16. An atomizer comprising:

a fuel swirler portion shaped to create a film of fuel when fuel is introduced therein; and an air swirler portion shaped to direct streams of air at said fuel film, said air swirler portion including a set of outer opening arranged in a configuration and a set of inner opening arranged in a configuration that is generally concentric with said set of outer openings, said inner and outer openings being arranged such that an air stream passed through one of said inner openings does not intersect an air stream passed through one of said outer openings unless both of said air streams are moving at least partially radially outwardly at said intersection.

17. An atomizer comprising:

a fuel output portion shaped to provide an output of fuel; and an air swirler portion shaped to direct streams of air at said fuel, said air swirler portion including an outer opening and an inner opening located radially inwardly relative to said outer opening, said inner and outer openings being arranged such that the projection on a plane of an air stream passed through said inner opening does not intersect the projection on said plane of an air stream passed through said outer opening unless both of said air streams are moving at least partially radially outwardly at said intersection.

18. A method for designing an air swirler having a body with a central axis, a front face, an inner opening and an outer opening comprising the steps of:

selecting a radial offset of each opening relative to said central axis;

selecting a pinch point distance for an air stream passed through each of said openings, said pinch point distance being located along said central axis and spaced from said front face;

selecting an angular offset of each of said openings relative to said central axis; and using said radial offset, said pinch point and said angular offset to determine the projection of the path of air streams passing through said openings based upon a hyperbola equation.

19. The method of claim 18 wherein said hyperbola equation is $$\frac{y^2}{a^2} - \frac{(x-h)^2}{b^2} = 1$$

wherein a represents the radial offset of said openings, h represents the pinch point, θ represents the angular offset of the openings, and b is a/(tan θ).

20. The method of claim 19 further comprising the step of repeating said selecting and determining steps to determine the path of air streams for a plurality of different values for said radial offset, pinch point and angular offset, and selecting selected ones of said values which provide a desired path of said air streams.

21. The method of claim 20 said selecting step includes selecting values for said radial offset, said pinch point and said angular offset such that an air stream passed through said inner opening does not intersect an air stream passed said outer opening unless said both of said intersecting air streams are moving at least partially outwardly relative to said central axis.

22. The atomizer of claim 1 wherein said air swirler portion is configured such that, in side view, the air streams passed therethrough do not intersect a radial centerline of said air swirler portion.

23. The atomizer of claim 1 wherein said air swirler portion includes a plurality of inner openings and a plurality of outer openings and is configured such that the air stream passed through one of said inner openings does not traverse an air stream passed through one of said outer openings.

24. The atomizer of claim 14 wherein said air swirler portion is configured such that, in side view, the air streams passed therethrough do not intersect a radial centerline of said air swirler portion.

25. The atomizer of claim 14 wherein said air swirler portion includes a plurality of inner openings and a plurality of outer openings and is configured such that the air stream passed through one of said inner openings does not traverse an air stream passed through one of said outer openings.

26. The atomizer of claim 15 wherein said air swirler portion is configured such that, in side view, the air streams passed therethrough do not intersect a radial centerline of said air swirler portion.

27. The atomizer of claim 15 wherein said air swirler portion is configured such that the air stream passed through one of said inner openings does not traverse an air stream passed through one of said outer openings.

28. The atomizer of claim 16 wherein said air swirler portion is configured such that, in side view, the air streams passed therethrough do not intersect a radial centerline of said air swirler portion.

29. The atomizer of claim 16 wherein said air swirler portion is configured such that the air stream passed through one of said inner openings does not traverse an air stream passed through one of said outer openings.

30. The atomizer of claim 17 wherein said air swirler portion is configured such that, in side view, the air streams passed therethrough do not intersect a radial centerline of said air swirler portion.

31. The atomizer of claim 17 wherein said air swirler portion includes a plurality of inner openings and a plurality of outer openings and is configured such that the air stream passed through one of said inner openings does not traverse an air stream passed through one of said outer openings.

* * * * *

UNITED STATES PATENT AND TRADEMARK OFFICE

CERTIFICATE OF CORRECTION

PATENT NO. : 6,863,228 B2
DATED : March 8, 2005
INVENTOR(S) : Chien-Pei Mao and John Earl Short It is certified that error appears in the above-identified patent and that said Letters Patent is hereby corrected as shown below:

Column 10,
Line 20, "19" should read -- 18 --.

Signed and Sealed this

Eleventh Day of April, 2006

JON W. DUDAS
*Director of the United States Patent and Trademark Office*